US010774453B2

(12) United States Patent
Erickson et al.

(10) Patent No.: US 10,774,453 B2
(45) Date of Patent: Sep. 15, 2020

(54) LAUNDRY TREATING APPLIANCE WITH A STATIC TUB AND A WATER TRAP VAPOR SEAL

(71) Applicant: WHIRLPOOL CORPORATION, Benton Harbor, MI (US)

(72) Inventors: Donald E. Erickson, Stevensville, MI (US); Brenner M. Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 235 days.

(21) Appl. No.: 15/864,270

(22) Filed: Jan. 8, 2018

(65) Prior Publication Data

US 2018/0127908 A1 May 10, 2018

Related U.S. Application Data

(60) Division of application No. 14/156,928, filed on Jan. 16, 2014, now Pat. No. 9,896,792, which is a (Continued)

(51) Int. Cl.

| | |
|---|---|
| ***D06F 37/26*** | (2006.01) |
| ***D06F 37/24*** | (2006.01) |
| ***D06F 17/06*** | (2006.01) |
| *D06F 21/08* | (2006.01) |
| *D06F 39/08* | (2006.01) |
| *D06F 17/08* | (2006.01) |

(Continued)

(52) U.S. Cl.

CPC ..... *D06F 17/06* (2013.01); *D06F 17/08* (2013.01); *D06F 21/08* (2013.01); *D06F 23/04* (2013.01); *D06F 37/12* (2013.01); *D06F 37/26* (2013.01); *D06F 39/083* (2013.01)

(58) Field of Classification Search

CPC ..... D06F 21/06; D06F 21/08; D06F 23/04; D06F 37/12; D06F 37/20; D06F 39/083

See application file for complete search history.

(56) References Cited

U.S. PATENT DOCUMENTS 1,700,749 A * 2/1929 Sinclair ..... D06F 23/04 68/4

2,777,314 A 1/1957 Smith et al.

(Continued)

FOREIGN PATENT DOCUMENTS

CN 1389616 A 1/2003

CN 101560721 A 10/2009

(Continued)

*Primary Examiner* — Joseph L. Perrin

*Assistant Examiner* — Irina Graf

(74) *Attorney, Agent, or Firm* — McGarry Bair PC

(57) ABSTRACT

A washing machine may include a static wash tub, a rotatable vertical axis wash basket in the static wash tub, and a drive motor for rotating the wash basket. A closure may direct wash liquid from the wash basket to a catch basin. A flange may be attached to the closure so that an unattached edge ends within the catch basin. The unattached edge may end below the surface of a first volume of wash liquid to minimize migration of wash liquid and/or vapor from the washing machine. The unattached edge may end above the surface of a second volume of wash liquid less than the first volume to minimize agitation of wash liquid in the catch basin.

19 Claims, 6 Drawing Sheets

Related U.S. Application Data continuation-in-part of application No. 13/970,733, filed on Aug. 20, 2013, now Pat. No. 9,828,714.

(51) Int. Cl.
*D06F 23/04* (2006.01)
*D06F 37/12* (2006.01)

(56) References Cited

U.S. PATENT DOCUMENTS

| | | | |
|---|---|---|---|
| 3,274,808 | A | 9/1966 | Morey |
| 3,710,947 | A | 1/1973 | Charhut |
| 3,793,854 | A | 2/1974 | Brucken |
| 4,321,809 | A | 3/1982 | Bochan |
| 4,689,973 | A | 9/1987 | Hershberger |
| 5,031,427 | A | 5/1991 | Mosby et al. |
| 5,586,455 | A | 12/1996 | Imai et al. |
| 6,354,115 | B1 | 3/2002 | Zahn |
| 8,166,590 | B2 | 5/2012 | Ashrafzadeh et al. |
| 8,176,798 | B2 | 5/2012 | Ashrafzadeh et al. |
| 8,215,134 | B2 | 7/2012 | Ashrafzadeh et al. |
| 8,381,569 | B2 | 2/2013 | Lilie et al. |
| 8,438,881 | B2 | 5/2013 | Ihne et al. |
| 2008/0289368 | A1 | 11/2008 | Braz et al. |
| 2010/0000022 | A1 | 1/2010 | Hendrickson et al. |
| 2010/0000024 | A1 | 1/2010 | Hendrickson et al. |
| 2010/0000264 | A1 | 1/2010 | Luckman et al. |
| 2010/0000573 | A1 | 1/2010 | Hendrickson et al. |
| 2010/0000581 | A1 | 1/2010 | Doyle et al. |
| 2010/0000586 | A1 | 1/2010 | Hendrickson |
| 2010/0251783 | A1 | 10/2010 | Barzizza et al. |
| 2011/0247148 | A1 | 10/2011 | Chanda et al. |
| 2012/0055204 | A1 | 3/2012 | Sun |
| 2012/0227189 | A1 | 9/2012 | Duncan et al. |
| 2013/0031938 | A1 | 2/2013 | Cho et al. |
| 2013/0036776 | A1 | 2/2013 | Seo et al. |
| 2013/0055769 | A1 | 3/2013 | Ha et al. |
| 2013/0119909 | A1 | 5/2013 | Clemons et al. |
| 2015/0052953 | A1 | 2/2015 | Erickson et al. |
| 2015/0052954 | A1 | 2/2015 | Erickson et al. |
| 2015/0176166 | A1 | 6/2015 | Alexander et al. |

FOREIGN PATENT DOCUMENTS

| | | | |
|---|---|---|---|
| CN | 102912593 | A | 2/2013 |
| EP | 2554734 | A | 2/2013 |
| GB | 625324 | A | 6/1949 |
| GB | 625326 | A | 6/1949 |
| GB | 654254 | A | 6/1951 |
| GB | 660292 | A | 11/1951 |
| JP | 02277494 | A | 11/1990 |
| JP | 1176681 | A | 3/1999 |
| KR | 20000002190 | A | 1/2000 |

* cited by examiner

LAUNDRY TREATING APPLIANCE WITH A STATIC TUB AND A WATER TRAP VAPOR SEAL

CROSS-REFERENCE TO RELATED APPLICATION

This application is a divisional application of and claims the benefit of U.S. patent application Ser. No. 14/156,928, filed Jan. 16, 2014, now U.S. Pat. No. 9,896,972, issued Feb. 20, 2018, which is a continuation-in-part of U.S. patent application Ser. No. 13/970,733, filed Aug. 20, 2013, now U.S. Pat. No. 9,828,714, issued Nov. 28, 2017, both of which are incorporated by reference herein in their entirety. This application is also related to U.S. patent application Ser. No. 14/641,492, filed Mar. 9, 2015, now abandoned, which is also a continuation-in-part of U.S. patent application Ser. No. 13/970,733, filed Aug. 20, 2013, now U.S. Pat. No. 9,828,714, issued Nov. 28, 2017.

BACKGROUND OF THE INVENTION

Laundry treating appliances, such as vertical axis washing machines, typically include a cabinet, a tub in the interior of the cabinet, and a rotatable wash basket mounted in the tub that receives laundry for treatment according to a cycle of operation. The tub may suspend from the cabinet, and may be supported by one or more suspension systems.

During the operation of the vertical axis washing machine with the suspended tub, the laundry load may be limited by the wash basket size, which is limited by the adjacent suspending tub. In case the laundry is non-uniformly distributed in the wash basket, an unbalance during the rotation of the wash basket may cause it to deviate off an anticipated rotational orbit, and in extreme cases induce collisions between the wash basket and the tub and/or the tub and the cabinet, based upon the selected basket/tub/cabinet design, such that spin extraction efficiency may be limited. Prior solutions have focused on predicting imbalances, altering the rotation, and applying rebalancers or counterbalancers.

Alternatively, vertical axis washing machines may have a static, or fixed, tub attached to the cabinet. The rotatable wash basket may be intercoupled with a rotatable drive shaft, a drive motor, a drive shaft bearing assembly, a transmission, and a support structure, all dynamically isolated from the tub. The support structure may be flexibly suspended from the tub, and may utilize a rubber boot to flexibly connect the support structure to the static tub. The rubber boot may seal wash liquid and vapor inside the washing machine to prevent leakage onto washing machine components and an adjacent support surface such as a floor, carpeting, and the like. While the static tub is beneficial in that it can aid in increasing the capacity of the washing machine, the wash liquid and vapor sealing apparatus may be more costly than non-static tub washing machines. Moreover, the wash liquid and vapor sealing apparatus may also be difficult to incorporate into washing machine components, may have a shorter life cycle than the non-static tub washing machines, and may also interact with the suspension systems, which may contribute to instability, vibration, and noise.

BRIEF DESCRIPTION

A washing machine may include a static wash tub, a rotatable vertical axis wash basket in the static wash tub, and a drive motor for rotating the wash basket. A closure may direct wash liquid from the wash basket to a catch basin. A flange may be attached to the closure so that an unattached edge ends within the catch basin. The unattached edge may end below the surface of a first volume of wash liquid to minimize migration of wash liquid and/or vapor from the washing machine. The unattached edge may end above the surface of a second volume of wash liquid less than the first volume to minimize agitation of wash liquid in the catch basin.

DETAILED DESCRIPTION

Figure 1:
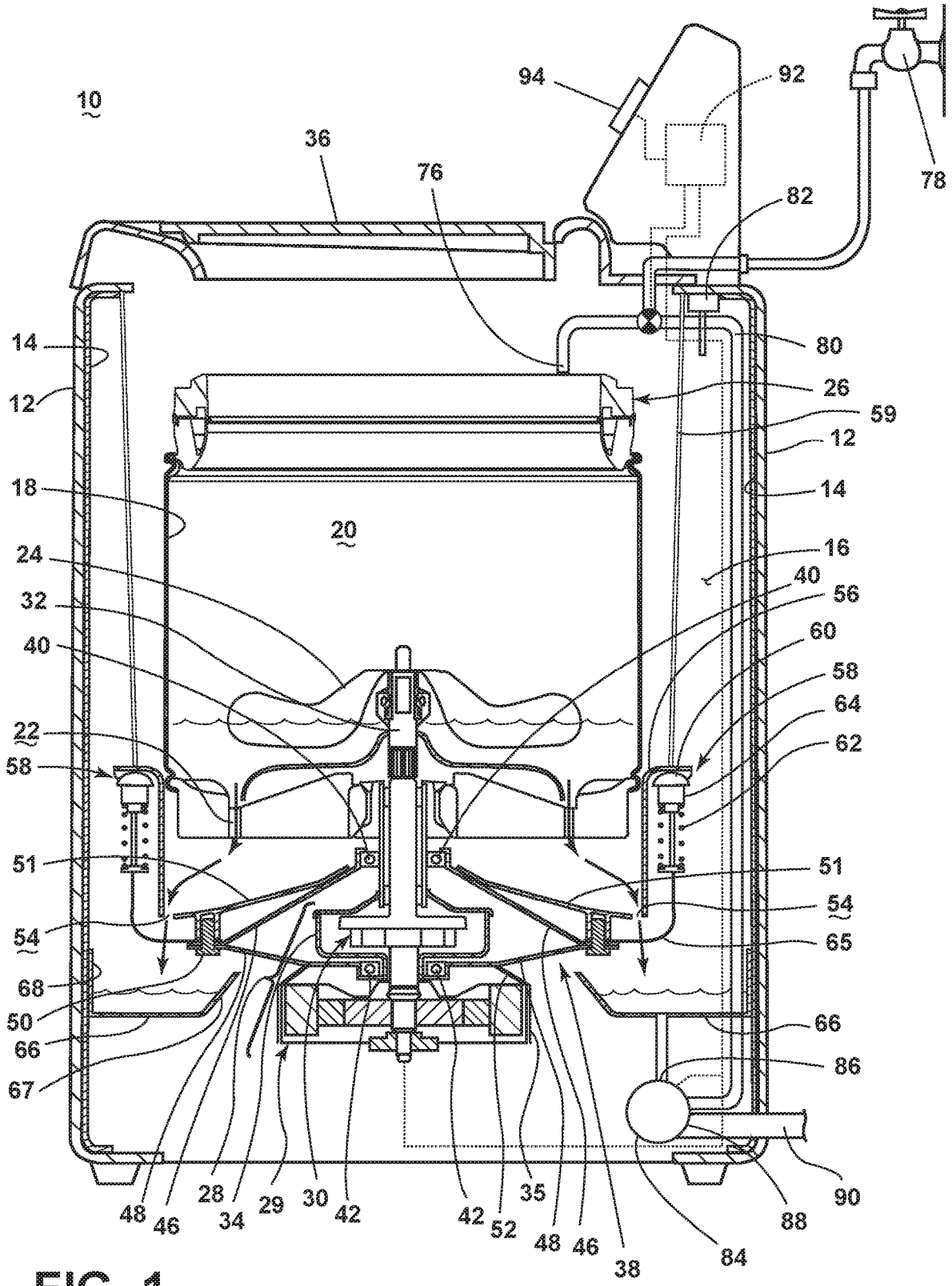
FIG. 1 is a schematic cross-sectional view of a laundry treating appliance with a static wash tub during a wash phase according to a first embodiment of the invention.

Referring now to the drawings, FIG. 1 is a schematic view of an exemplary laundry treating appliance 10 in the form of a washing machine according to a first embodiment of the invention. While the laundry treating appliance 10 is illustrated as a vertical axis, top-fill washing machine, the invention may have applicability in other laundry treating appliances, such as a horizontal axis washing machine, a combination laundry treating appliance and dryer, an extractor, a non-aqueous laundry treating appliance, and a tumbling or stationary refreshing/revitalizing machine, for example.

The washing machine 10 may include a cabinet or housing 12, and a static wash tub 14 which is in fixed position with respect to the cabinet 12. In one example, as illustrated in FIG. 1, the static wash tub 14 may be integrated to the cabinet 12, and define an interior 16 of the washing machine 10. By "static wash tub," it is not necessarily meant that the tub is fixedly integrated to the cabinet 12. Alternately, the tub 14 may be referred to as the static wash tub as long as the tub 14 is in a fixed position with respect to the cabinet 12. For example, the static wash tub may be spaced from the cabinet 12 by a predetermined distance.

A drum or wash basket 18 may be located within and rotatable relative to the interior 16 of the tub 14 and may define a laundry treating chamber 20 for receiving a laundry load. The wash basket 18 may include one or more drain holes 22 formed on the base portion of the wash basket 18 to discharge the liquid from the wash basket 18 through one or more drain holes 22. An agitator or clothes mover 24 may be located within the laundry treating chamber 20 and rotatable relative to and/or with the wash basket 18. For example, the agitator 24 may be commonly oscillated or rotated about its axis of rotation during a cycle of operation in order to provide movement to the fabric load contained within the laundry treating chamber 20. A balance ring 26 may be coupled to a top portion of the wash basket 18 for eliminating unbalance from the rotation of laundry items that are non-uniformly distributed in the wash basket 18.

An electric motor assembly 28 may be provided to drive the wash basket 18 and/or the agitator 24. The electric motor assembly 28 may include a motor 29, a transmission 30, a shaft 32, a motor housing 33, and a transmission housing 34. The electric motor assembly 28 may be operably connected to the wash basket 18 and/or the agitator 24. For example, the shaft 32 may be rotatably coupled to the agitator 24. The motor housing 33 may include a flange-like drip loop 35 to divert moisture that may otherwise interfere with the motor 29, particularly a rotor. The drip loop 35 may be incorporated into the motor housing 33, or may be attached to a bearing housing element 48 immediately above the motor housing 33. The drip loop 35 may extend to a suitable termination elevation, e.g. termination just below the motor housing 33.

The top of the cabinet 12 may include a selectively openable lid 36 to provide access into the laundry treating chamber 20 through the open top of the wash basket 18.

A liquid trap system may be provided to the interior 16 of the washing machine 10 for controlling the flow of liquid such as water or a combination of water and one or more treating chemistries from impacting the electric motor assembly 28. A bearing housing 38 may be provided to the interior 16 of the washing machine 10 for protection of the electric motor assembly 28 from moisture, and controlling the flow of liquid from the wash basket 18 to the exterior to the bearing housing 38. As illustrated in FIG. 1, the bearing housing 38 may be positioned under the wash basket 18, i.e. around the transmission housing 34, above the motor housing 33, and within the static wash tub 14, to direct the flow of liquid from the wash basket 18 to the perimeter of the bearing housing 38.

A first bearing 40 may be positioned above the motor assembly 28, and a second bearing 42 may be positioned between the transmission housing 34 and the motor housing 33. The bearings 40, 42 may be coupled with a first bearing housing element 46 and a second bearing housing element 48, respectively, to define the bearing housing 38. The bearings 40, 42, along with the bearing housing elements 46, 48, may define a structure having suitable strength for support of the motor assembly 28, shaft 32, and associated components. The bearing housing elements 46, 48 may be fabricated of stainless steel, or a suitable high strength plastic. The first bearing housing element 46 may include openings therethrough (not shown) to enable air circulation through the interior of the bearing housing 38 for cooling of the motor 29. The motor housing 33 may be suspended from the first bearing housing element 46 by coupling the motor housing 33 with the second bearing housing element 48 through a suitable housing coupler 52. Alternatively, the motor housing 33 may be integrated during fabrication into the second bearing housing element 48.

Alternative motor assemblies with differing configurations than illustrated in the drawings may be used. For example, a direct drive motor with an exterior rotor and an interior stator may be used with or without a transmission, based upon clearance requirements beneath the motor assembly. The stator may be attached to the second bearing housing element 48, with the rotor rotating around the stator. Or the stator may be attached to the motor housing 33, with the motor housing 33 attached to the second bearing housing element 48.

The bearing housing elements 46, 48 may be part of an assembly for attenuating the vibration generated from the operation of the rotatable wash basket 18. As illustrated in FIG. 1, one end portion of a first bearing housing element 46 may downwardly extend from the first bearing 40 to form a slanted plane. One end portion of a second bearing housing element 48 may be coupled to and extend from the second bearing 42 to form an upwardly slanted plane. The other end portions of the first and second bearing housing elements 46, 48 may be coupled to a seal 50 such as a labyrinth seal. The bearing housing elements 46, 48 may selectively provide moisture protection to the motor assembly 28.

The bearing housing 38 may also include a closure 51 extending generally from the first bearing 40 for coupling with the labyrinth seal 50. The closure 51 may be an annular, somewhat bowl-shaped body having a raised center, positioned above the first and second bearing housing elements 46, 48, with one or more drain ports 54 at a lower annular portion. From the lower annular portion (associated with the drain ports 54), the closure 51 may extend upwardly to transition to a radially outwardly directed circumferential mounting flange 56. The mounting flange 56 may be coupled to a suspension system 58 that may comprise a rod 59, cap 60, elastic spring 62, and damper 64. The closure 51 may provide moisture protection for the motor assembly 28, and may be fabricated of stainless steel or high strength plastic.

A plurality of suspension systems 58 may be provided in the interior 16 of the washing machine 10 for damping the vibrations generated during the rotational movement of the wash basket 18. The suspension system 58 may be operably coupled to the cabinet 12 via the rod 59. A flexure element 65 may downwardly extend from the damper 64 to operably couple the suspension system 58 to one of the first and second bearing housing elements 46, 48 via the seal 50 for damping the vibrations from the first and second bearing housing elements 46, 48. The flexure element 65 may be made of metallic material, and may be in the form of a rod, plate, spring, or the like. The closure 51, mounting flange 56, and flexure element 65 may comprise a single integrated component.

A catch basin 66 may be fixedly positioned in the lower portion of the cabinet 12. As illustrated in FIG. 1, the catch basin 66 may have walls for accommodating a predetermined amount of wash liquid draining from the wash basket 18. The catch basin 66 may be positioned underneath the bearing housing 38, and the position of the catch basin 66 may be determined such that the catch basin 66 may receive the liquid flowing downwardly by gravity through the drain ports 54. The catch basin 66 may include first and second walls 67, 68, with the second wall 68 sealably coupled to the static wash tub 14 for preventing the leak of wash liquid and/or vapor through the gap between the second wall 68 and the static wash tub 14. While the catch basin 66 may be located within the interior of the cabinet 12, it may be understood that positioning the catch basin 66 exterior of the cabinet 12 may also be possible in another embodiment.

The catch basin 66 may be provided with a liquid level sensor for determining the liquid height in the catch basin 66. The catch basin 66 may also be provided with a turbidity sensor for determining the turbidity of the wash liquid received in the catch basin 66.

A spraying system may be provided to supply the liquid, such as water or a combination of water and one or more treating chemistries into the open top of the wash basket 18.

The spraying system may be configured to recirculate wash liquid from the catch basin 66, and spray it onto the laundry via a recirculation conduit 80 and a sprayer 76. The nature of the spraying system is not germane to the invention, and thus any suitable spraying system may be used with the washing machine 10.

A dispensing system may be provided to the washing machine 10 for supplying treating chemistry to the treating chamber 20 according to a cycle of operation. The dispensing system may include a detergent dispenser 82 which may be a single use dispenser, a bulk dispenser or a combination of a single use and bulk dispenser. As illustrated in FIG. 1, the detergent dispenser 82 may be positioned within the static wash tub 14, and may be disposed vertically above the catch basin 66 for providing one or more treating chemistries to the catch basin 66 by gravity according to a cycle of operation. The detergent dispenser 82 may include a conduit with a predetermined dimension for guiding the supply of one or more treating chemistries to the catch basin 66. The treating chemistries may be in the form of at least one of liquid, powder, pod, compressed puck, or combination thereof.

The treating chemistries may be provided without being mixed with wash liquid from the recirculation conduit 80 or water from the household water supply 78. In another embodiment, the detergent dispenser 82 may be operably configured to dispense a treating chemistry mixed with water supplied from the household water supply 78 through the sprayer 76. The sprayer 76 may be configured to dispense the treating chemistry into the treating chamber 20 in a desired pattern and under a desired amount of pressure. For example, the sprayer 76 may be configured to dispense a flow or stream of treating chemistry into the tub 14 by gravity, i.e. a non-pressurized stream.

Non-limiting examples of suitable dispensers are disclosed in U.S. Pub. No. 2010/0000022 to Hendrickson et al., filed Jul. 1, 2008, now U.S. Pat. No. 8,196,441, issued Jun. 12, 2012, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, now U.S. Pat. No. 8,388,695, issued Mar. 5, 2013, entitled "Apparatus and Method for Controlling Laundering Cycle by Sensing Wash Aid Concentration," U.S. Pub. No. 2010/0000573 to Hendrickson et al., filed Jul. 1, 2008, now U.S. Pat. No. 8,397,328, issued Mar. 19, 2013, entitled "Apparatus and Method for Controlling Concentration of Wash Aid in Wash Liquid," U.S. Pub. No. 2010/0000581 to Doyle et al., filed Jul. 1, 2008, now U.S. Pat. No. 8,813,526, issued Aug. 26, 2014, entitled "Water Flow Paths in a Household Cleaning Appliance with Single Use and Bulk Dispensing," U.S. Pub. No. 2010/0000264 to Luckman et al., filed Jul. 1, 2008, now abandoned, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, now U.S. Pat. No. 8,397,544, issued Mar. 19, 2013, entitled "Household Cleaning Appliance with a Single Water Flow Path for Both Non-Bulk and Bulk Dispensing," and U.S. patent application Ser. No. 13/093,132, filed Apr. 25, 2011, now U.S. Pat. No. 8,438,881, issued May 14, 2013, entitled "Method and Apparatus for Dispensing Treating Chemistry in a Laundry Treating Appliance," all of which are herein incorporated by reference in full.

Non-limiting examples of treating chemistries that may be dispensed by the dispensing system during a cycle of operation include one or more of the following: water, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

A recirculation and drain system may be provided to the laundry treating appliance 10 for recirculating liquid within and/or draining liquid from the laundry treating appliance 10. A pump 84 may be housed below the bearing housing 38. The pump 84 may have an inlet 86 fluidly coupled to the sump 66 and an outlet 88 configured to fluidly couple to a recirculation conduit 80 and a drain conduit 90. It is understood that the pump 84 may be configured to switch the pumping direction by operating the motor coupled to the pump 84 in the reverse direction.

Alternatively, two separate pumps, such as a recirculation pump and a drain pump, may be used instead of the single pump as previously described, in which case, at least one of the recirculation pump or the drain pump may be fluidly coupled to a drain conduit 90 for flushing the liquid out of the washing machine 10 according to a treating cycle of operation. It is understood that the recirculation pump, similar to the pump 84, may be configured to switch the pumping direction by operating the motor in the reverse direction.

Additionally, the spraying system, the dispensing system, and the recirculation and drain system may differ from the configuration shown in FIG. 1, such as by inclusion of other valves, conduits, treating chemistry dispensers, sensors and the like, to control the flow of liquid through the washing machine 10 and for the introduction of more than one type of treating chemistries.

As used herein, the term "wash liquid" refers to water or a combination of water and one or more treating chemistries such as those capable of generating suds. The terms "rinse liquid" and "rinse water" are interchangeable and refer to water supplied from the household water supply 78 that has not been mixed with a treating chemistries prior to being applied to the laundry.

The washing machine 10 also includes a control system for controlling the operation of the washing machine 10 to implement one or more cycles of operation. The control system may include a controller 92 and a user interface 94 that is operably coupled with the controller 92. The user interface 94 may include one or more knobs, dials, switches, displays, touch screens and the like for communicating with the user, such as to receive input and provide output. The user may enter different types of information including, without limitation, cycle selection and cycle parameters, such as cycle options.

The controller 92 may include the machine controller and any additional controllers provided for controlling any of the components of the washing machine 10. For example, the controller 92 may include the machine controller and a motor controller. Many known types of controllers may be used for the controller 92. The specific type of controller is not germane to the invention. It is contemplated that the controller 92 is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
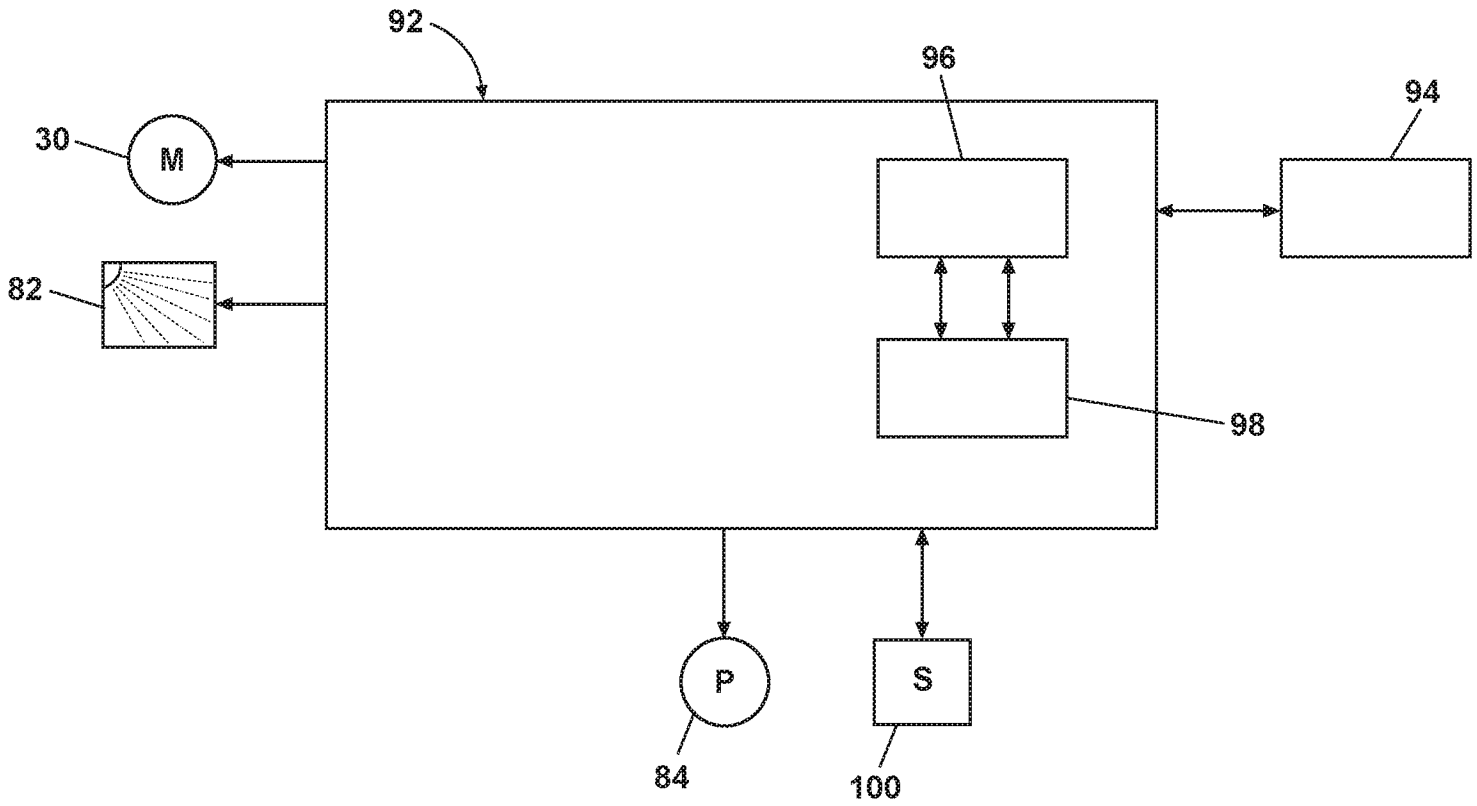
FIG. 2 is a schematic view of a controller of the laundry treating appliance of FIG. 1.

As illustrated in FIG. 2, the controller 92 may be provided with a memory 96 and a central processing unit (CPU) 98. The memory 96 may be used for storing the control software that is executed by the CPU 98 in implementing a cycle of operation using the washing machine 10 and any additional software. Examples, without limitation, of cycles of operation include: wash, heavy duty wash, delicate wash, quick wash, pre-wash, refresh, rinse only, and timed wash. A common wash cycle includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases.

The memory 96 may also be used to store information, such as a database or table, and to store data received from one or more components of the washing machine 10 that may be communicably coupled with the controller 92. The database or table may be used to store the various operating parameters for the one or more cycles of operation, including factory default values for the operating parameters and any adjustments to them by the control system or by user input.

The controller 92 may be operably coupled with one or more components of the washing machine 10 for communicating with and controlling the operation of the component to complete a cycle of operation. For example, the controller 92 may be operably coupled with the motor 30, the pump 84, and the detergent dispenser 82 to control the operation of these and other components to implement one or more of the cycles of operation.

The controller 92 may also be coupled with one or more sensors 100 provided in one or more of the systems of the washing machine 10 to receive input from the sensors, which are known in the art and not shown for simplicity. Non-limiting examples of sensors 100 that may be communicably coupled with the controller 92 include: a treating chamber temperature sensor, a moisture sensor, a weight sensor, a chemical sensor, a position sensor, a motor torque sensor, the liquid level sensor, and the turbidity sensor, which may be used to determine a variety of system and liquid characteristics. For example, when the turbidity of one of the wash liquid or rinse liquid in the wash basket 18 or the catch basin 66 satisfies a predetermined threshold, the wash liquid or rinse liquid may be drained by the activation of the pump 84, and fresh water may be supplied to the wash basket 18 from the household water supply 78.

Typically, a vertical axis washing machine having a tub suspended from a cabinet, and a rotatable wash basket disposed in the tub, may have multiple performance limitations. For example, the size of the wash basket and corresponding capacity of laundry load may be limited by the position of the suspended tub in the vicinity of the rotatable wash basket and one or more suspension systems exterior of the suspended tub in the cabinet. In another example, the spin speed for the wash basket during a rinse phase may not be maintained at a very high speed due to the potential collision between the wash basket and the suspended tub from an unbalance associated with non-uniformly distributed laundry load in the wash basket. In yet another example, the treating efficiency of laundry items is known to be limited due to discrete steps comprising water supply, agitation, rinsing, compared to out of water wash where wash liquid is continuously supplied to the laundry load for continuously treating laundry items.

The operation of the washing machine 10 with the static wash tub 14 may be different from the operation of a typical vertical axis washing machine having a suspending tub. It is assumed that laundry items may be received in the wash basket 18 prior to or during a cycle of treating operation.

When the wash phase in the wash cycle begins, water may be provided from the household water supply 78. The water may percolate through the laundry items in the wash basket 18, and drain downwardly by gravity through the drain holes 22. The agitator 24 may rotate in at least one of the clockwise or counter clockwise directions for engaging the laundry with the agitator 24 at a predetermined speed according to a cycle of operation. The drain holes 22 may be configured to open, therefore the water may drain through the drain holes 22 when the basket 18 is either in a stationary mode or rotates according to a cycle of operation. Once passing through the drain holes 22, the water may be received downwardly by the surface of the closure 51 until the water is received in the catch basin 66 through one or more drain ports 54.

The height of wash liquid in the catch basin 66 may be determined by the amount of water initially provided from the household water supply 78 to the treating chamber 20 of the wash basket 18. Therefore water may be supplied to the wash basket 18 until the water height in the catch basin 66 satisfies a predetermined threshold. For example, an output from the water level sensor may be monitored to determine when the water supply to the wash basket 18 needs to be stopped.

The water received in the catch basin 66 may be provided with one or more treating chemistries supplied from the detergent dispenser 82 to the interior of the catch basin 66, and the water and one or more treating chemistries may be physically and/or chemically mixed to each other to form wash liquid. The wash liquid may subsequently be supplied to the inlet 86 of the pump 84 for recirculation through the recirculation conduit 80 back to the laundry items in the wash basket 18. The wash liquid, now a mixture of water and one or more treating chemistries may be percolated through the laundry items in the wash basket 18 while the agitator 24 rotates according to a cycle of operation.

It may be noted that, during the wash phase, the wash liquid may be continuously recirculated from the wash basket 18, through drain holes 22 of the wash basket 18, drain ports 54 of the closure 51, pump 84, recirculation conduit 80, and then back to the wash basket 18. It may also be noted that treating laundry based on the continuous or semi-continuous percolation of wash liquid may be effective in improving the treating performance of laundry items, compared to a traditional treating step comprising discrete steps of water supply, agitation, and rinsing.

When the wash phase is complete, the wash liquid received in the catch basin 66 may be drained out of the washing machine 10 by activating the pump 84 in the drain mode. In another embodiment where two separate pumps are operable, the drain pump may be activated to drain wash liquid out of the washing machine 10. Prior to the activation of the pump 70 for draining the wash liquid, the liquid height in the catch basin 66 may be monitored by the water level sensor, and the activation of the pump 84 for draining wash liquid may continue until the wash liquid height satisfies a predetermined threshold range.

The wash phase may be followed by the rinse phase. During the rinse phase, water may be provided to the laundry items in the wash basket 18 through the sprayer 76. Similar to the wash phase, the water supplied from the household water supply 78 may be percolated through the laundry items while the laundry items are agitated by the agitator 24 according to a cycle of operation. During the rinse phase, the water may continuously drain out of the wash basket 18 through one or more drain holes 22, pass through one or more drain ports 54, and then recirculated back to the wash basket via the recirculation conduit 80 by the pump 70. One or more treating chemistries for a rinse phase may be provided to the catch basin 66 prior to the onset of or during the rinse phase.

Figure 3:
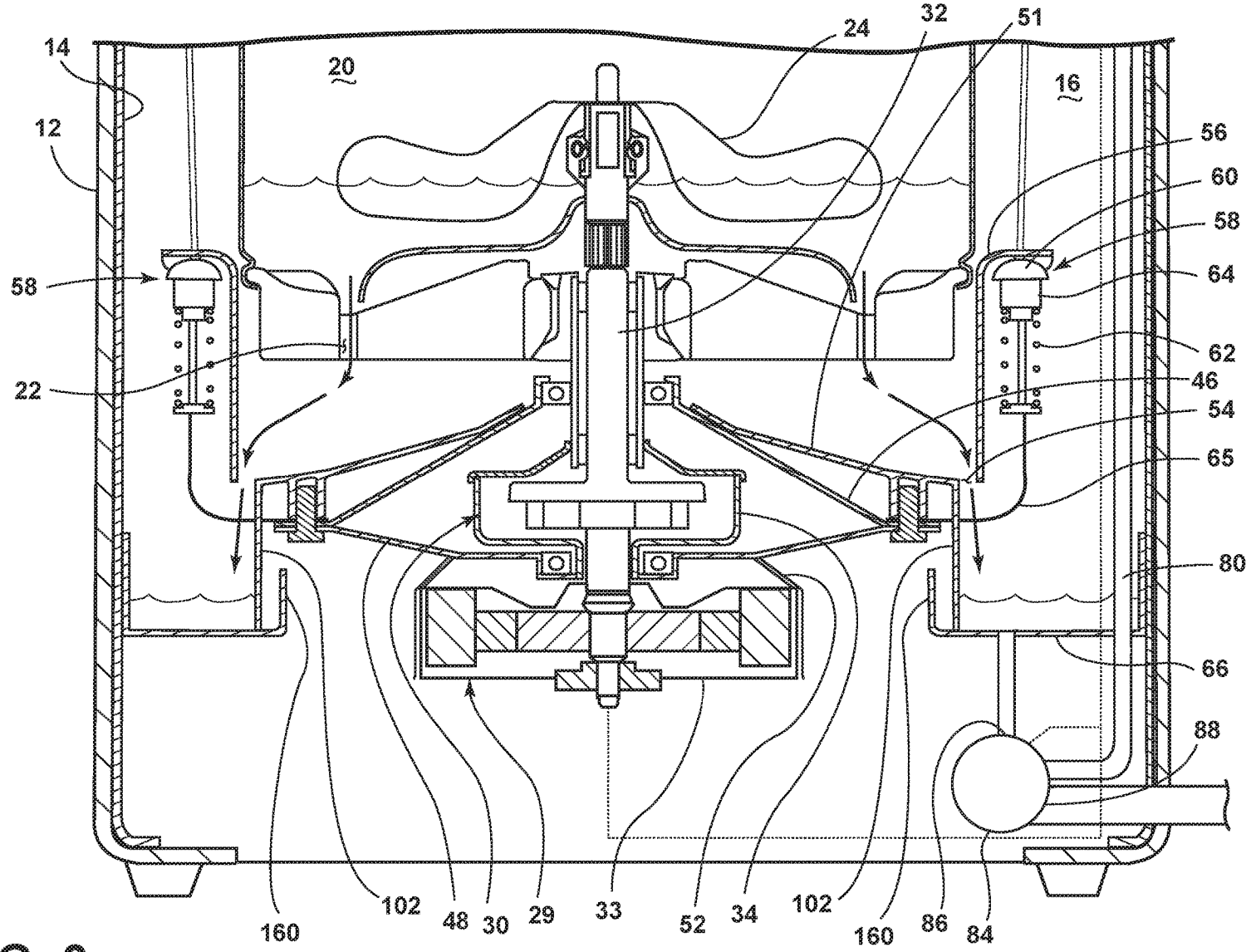
FIG. 3 is an enlarged schematic cross-sectional view of a laundry treating appliance with a static wash tub during a wash phase according to a second embodiment of the invention.

Referring to FIG. 3, a schematic cross-sectional view of a laundry treating appliance with a static wash tub according to a second embodiment of the invention is illustrated wherein the laundry treating appliance is in the wash phase.

The primary difference between the first embodiment in FIG. 1 and the second embodiment in FIG. 3 may be a flange 102 mounted to the closure 51. As illustrated, the flange 102 may be coupled to a low end portion of the closure 51 such that the flange 102 may extend downwardly from the low end portion of the closure 51 until one end portion of the flange 102 contacts the bottom of the catch basin 66 during the wash phase.

The flange 102 may be configured to form a seal when the flange 102 contacts the bottom of the catch basin 66. As a result, the flange 102 may act as a trap for confining the wash liquid and/or vapor inside the interior 16 of the static wash tub 14. For example, the flange 102 may form a trap seal with the bottom of the catch basin 66 for blocking the wash liquid and/or vapor escaping from the catch basin 66 and interior 16 of the static wash tub 14. Confining wash liquid and/or vapor inside the static wash tub 14 may prevent the impingement of wash liquid and/or vapor into other parts of the laundry treating appliance. In one example, the motor assembly 28 may be protected from any impingements of wash liquid and/or vapor that may adversely affect the operation of the motor assembly 28 while wash liquid recirculates through the pump 84 and recirculation conduit 80 back to the treating chamber 20.

Figure 4:
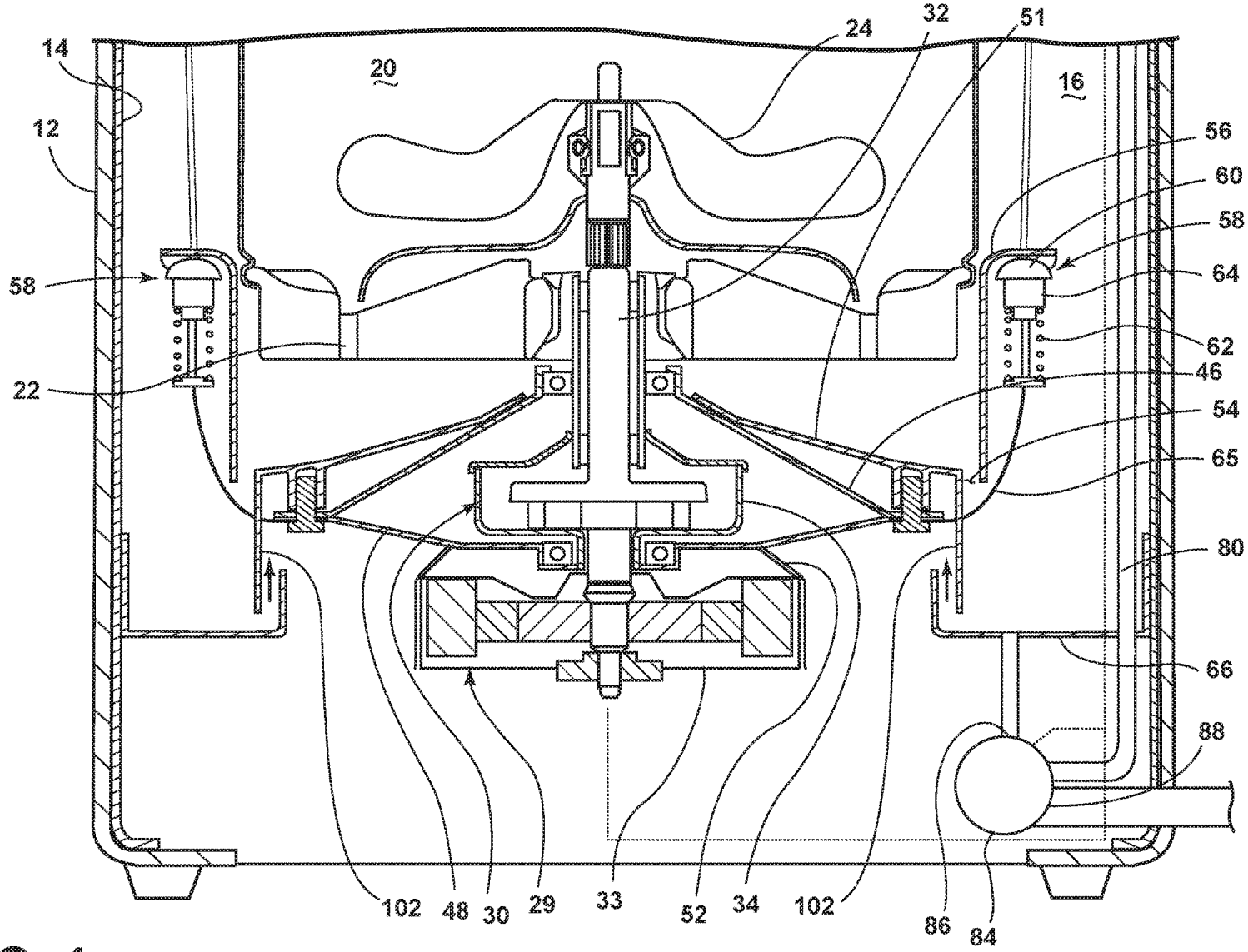
FIG. 4 is an enlarged schematic cross-sectional view of the laundry treating appliance with the static wash tub of FIG. 3 during a spin phase according to a third embodiment of the invention.

FIG. 4 is a schematic cross-sectional view of the laundry treating appliance of FIG. 3 according to a third embodiment of the invention, where the laundry treating appliance in FIG. 4 is in a spin extraction phase. When the wash phase is complete, the wash liquid may be drained out of the catch basin 66, followed by the spin extraction phase where the wash basket 18 rotates at a high spin speed.

It is understood that, during the high speed spin extraction phase, the wash basket 18 may be subject to a translational and/or vertical movement from any unbalance of non-uniformly distributed laundry items in the wash basket 18. The translational and/or vertical movement of the wash basket 18 may be transmitted to other coupled components in the form of vibration. In one example, vibration may transmit to the bearing housing 38, the flange 102, the flexure element 65, and the suspension system 58.

The suspension system 58 may move horizontally and/or vertically for damping out the vibrations of the wash basket 18 during the spin extraction phase. In one example, during the vibration damping, the elastic spring 62 of the suspension system 58 may be compressed for damping out the vibrations, which may lift up the flexure element 65 in an upward direction. As a result, the closure 51 and first/second bearing housing elements 46, 48, which are coupled to the flexure element 65, and the flange 102, which is coupled to the closure 51, may be also lifted up during the vibration damping.

Lifting up the flange 102 during the high speed rinse phase may disengage the flange 102 from the bottom of the catch basin 66, and the vibrations transmitted from the wash basket 18 may not be transferred to the catch basin 66, as illustrated in FIG. 4. When the spin extraction phase is complete, the elastic spring 62 may be extended back to its original length, and the flange 102 may move downwardly until the flange 102 contacts the bottom of the catch basin 66.

Figure 5:
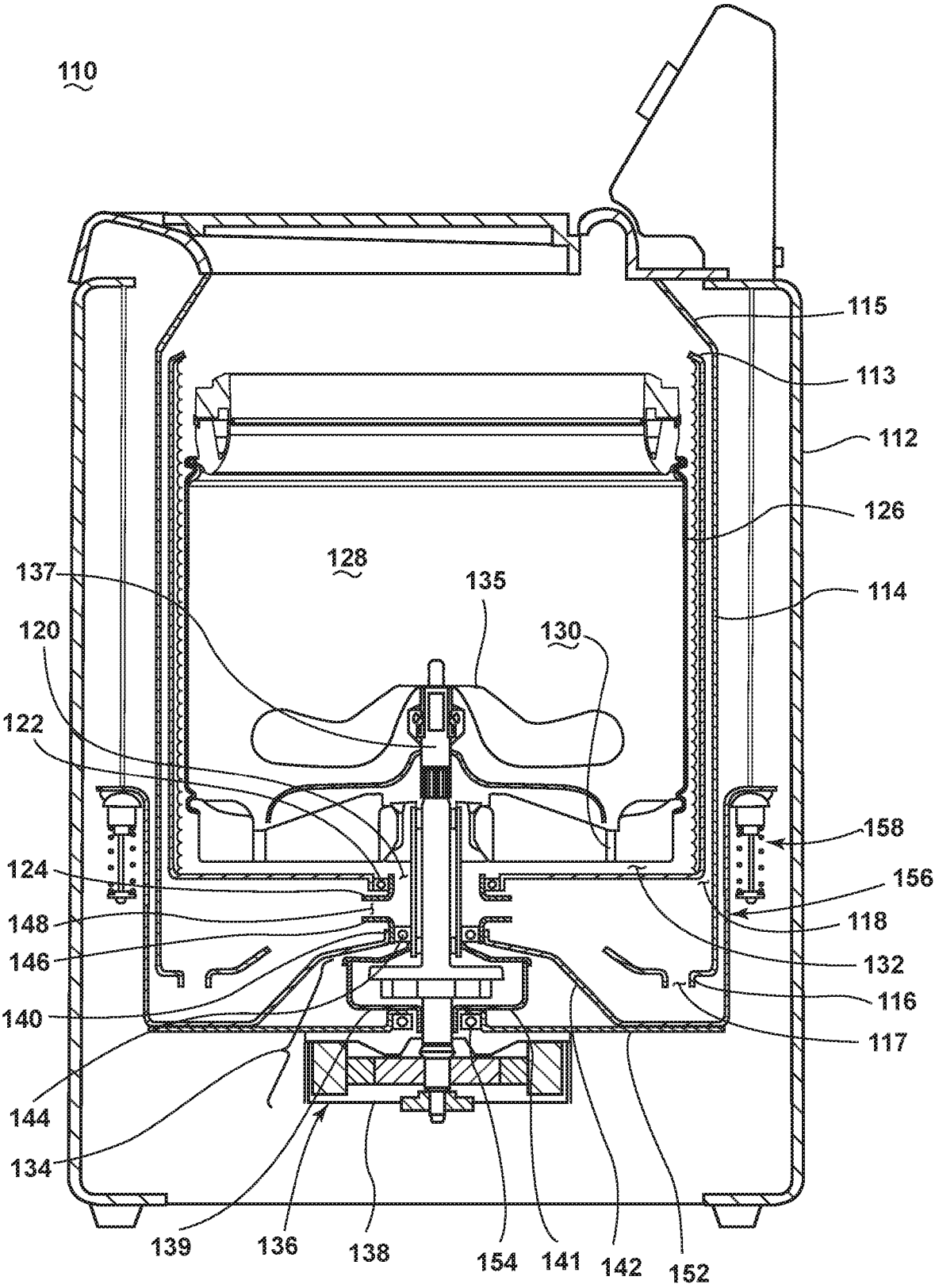
FIG. 5 is a schematic cross-sectional view of a laundry treating appliance with a static wash tub during a wash phase according to a fourth embodiment of the invention.

FIG. 5 is a schematic cross-sectional view of a laundry treating appliance 110 with a static wash tub 114 during the wash phase according to a fourth embodiment of the invention. The laundry treating appliance 110 may be different from a laundry treating appliance 10 in FIG. 1 in that the laundry treating appliance 110 includes a rotatable tub 113 between a wash basket 126 and a static wash tub 114.

As illustrated, the laundry treating appliance 110 comprises a cabinet 112, and a static wash tub 114 which may be spaced from the cabinet 112 by a predetermined distance. First end portion 115 of the static wash tub 114 may be coupled to the cabinet 112, while the second end portion 116 may extend downwardly to form a drain opening 117. A rotatable tub 113 may be located within and rotatable relative to the interior 118 defined by the static wash tub 114. The rotatable tub 113 may be in the form of a cylinder with a closed bottom, and may include an opening 120 at the center of the closed bottom. The rotatable tub 113 may be rotatably coupled to a first bearing 122, which may be in the form of a seal bearing. A first outlet portion 124 may extend from the first bearing 122.

A rotatable drum or wash basket 126 may be located within the rotatable tub 113 for defining a laundry treating chamber 128 for receiving a laundry load. The wash basket 126 may be configured to rotate at a predetermined speed according to a cycle of operation. It is understood that the wash basket 126 and rotatable tub 113 may be configured to rotate at the same time. It is also noted that the wash basket 126 and rotatable tub 113 may rotate substantially at identical speed relative to each other. The wash basket 126 may include one or more drain holes 130 formed on the base portion of the wash basket 126, and one or more drain holes 130 may be fluidly coupled to the space 132 formed by the exterior of the wash basket 126 and the inner wall of the rotatable tub 113.

An electric motor assembly 134 may be provided to drive the wash basket 126, rotatable tub 113, or an agitator 135 according to a cycle of operation. The electric motor assembly 134 may include a motor 136, a shaft 137, and a motor housing 138 for accommodating the motor 136. The electric motor assembly 134 may be positioned on the motor 139.

One or more bearing housing elements may be provided to the laundry treating appliance for attenuating the vibration generated from the operation of the rotatable wash basket 126 and/or preventing wash liquid impinging into the motor assembly 134. First end portion 140 of a first bearing housing element 142 may extend from a second bearing 144. A second outlet portion 146 may extend from the first end portion 140 of the first bearing housing element 142, with the second outlet portion 146 combined with the first outlet portion 124 to form an outlet 148.

The outlet 148 may be coupled to a recirculation conduit and pump (not shown) for recirculating wash liquid back to the treating chamber or draining wash liquid out of the laundry treating appliance 110.

A second bearing housing element 152 may extend from a third bearing 154 in a horizontal direction until the second bearing housing element 152 may be coupled to the first bearing housing element 142 to form a closure 156. The closure 156 may be coupled to a suspension system 158, which may be operably coupled to the cabinet 112 for damping out the vibration from the movement of the wash basket 126 and/or the rotatable tub 113.

Other components and sensors such as the electric motor assembly, the spraying system, the dispensing system, the recirculation and drain system, and the controller are well known, and may not be described in detail unless necessary for a complete understanding of the invention.

In operation, during a wash phase, wash liquid may be provided to the treating chamber 128 of the wash basket 126, percolate through the laundry items in the wash basket 126, and drain downwardly through the drain holes 130. Wash liquid may be further removed from the laundry items in the spin extraction phase by rotating the wash basket 126 at a predetermined speed. When the wash basket 126 rotates, the rotatable tub 113 may also rotate at a substantially identical speed with the wash basket 126. While the wash basket 126 and rotatable tub 113 rotate, wash liquid may be extracted from laundry items through the drain holes 130 along the inner wall of the rotatable tub 113 by a centrifugal force to form a wash liquid layer along the height of the rotatable tub 113.

The distribution of the wash liquid layer on the inner wall of the rotatable tub 113 may vary with treating parameters. In one example, the drain holes 130 of the wash basket 126 may be configured to control the flow direction and magnitude of wash liquid extracted from drain holes 130 in the wash basket 126. For example, by controlling the location and angle of the drain holes 130 relative to the rotational axis of the wash basket 126, the wash liquid may be distributed such that the amount of wash liquid may substantially compensate for the unbalance from laundry items to spin the wash basket 126 at its maximum spin speed.

When the wash basket 126 is stationary, centrifugal force on the wash liquid may no longer be effective. Wash liquid may flow down to the lower portion of the rotatable tub 113 to be collected, and may be drained through the opening 120 to the outlet 148, where the wash liquid may be recirculated to the wash basket 126 via the recirculation conduit and pump (not shown). Alternately wash liquid may be drained out of the laundry treating appliance by the pump by switching the pumping direction of the pump.

During the spin extraction phase, the wash liquid may spill out of the top of the rotatable tub 113. The spilled wash liquid may be confined to the interior 118 by the static wash tub 114. In one example, the spilled wash liquid may flow down the space formed between the rotatable tub 113 and the static wash tub 114, and may be collected at the drain opening 117, where the wash liquid may be either recirculated or drained.

Figure 6:
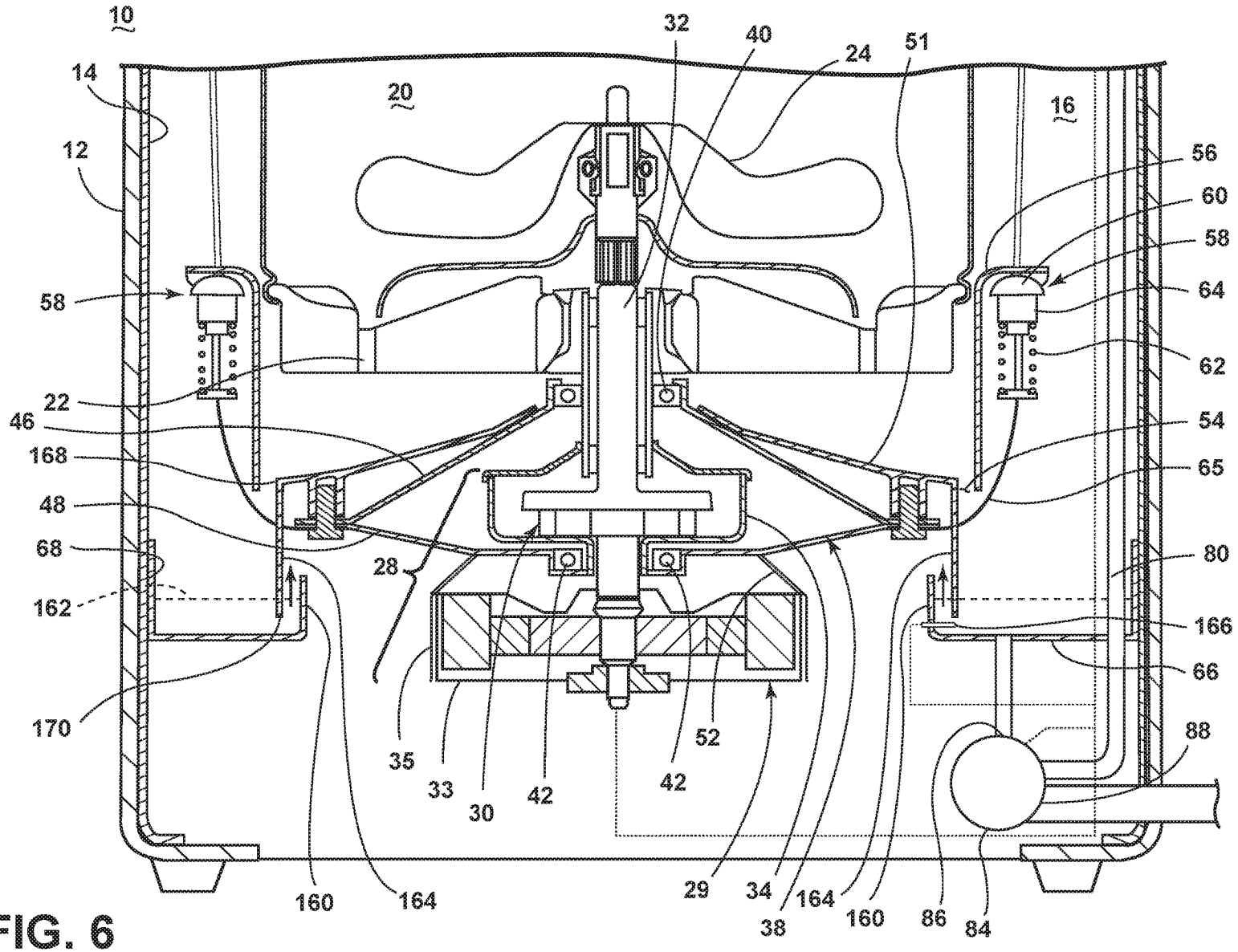
FIG. 6 is an enlarged schematic cross-sectional view of the laundry treating appliance of FIG. 4 during a wash phase according to an exemplary fifth embodiment of the invention.

FIG. 6 illustrates a portion of the laundry treating appliance 10 during the wash phase according to an exemplary fifth embodiment of the invention. The laundry treating appliance 10 of FIG. 6 may include many of the functionalities hereinbefore described and illustrated in FIGS. 1-5, a description of which will not be repeated unless otherwise necessary for a complete understanding of the invention.

The exemplary fifth embodiment of FIG. 6 may be essentially identical to the third embodiment illustrated in FIG. 4, except that the third embodiment may relate to a spin extraction phase and the exemplary fifth embodiment may relate to a wash phase. Furthermore, the third embodiment may include the flange 102 mounted to the closure 51, while in the exemplary fifth embodiment, the flange may be in the form of an annular vapor seal skirt 164, which may be made from plastic. Specifically, during the wash cycle, the flange 102 of the third embodiment may be in sealing contact with the bottom of the catch basin 66, in contrast with the exemplary fifth embodiment in which the vapor seal skirt 164 may extend beneath the wash liquid level 162, but not to the bottom of the catch basin 66.

As illustrated in FIGS. 1, 3, 4, and 6, the closure 51 may have the general shape of a truncated cone. An attached edge 168 of the vapor seal skirt 164 may be attached along a circumferential edge of the closure 51 so that an unattached edge 170 of the vapor seal skirt 164 may depend into the interior of the catch basin 66, thus enabling the unattached edge 170 of the vapor seal skirt 164 to end between the top of the catch basin inner wall 160 and the bottom of the catch basin 66.

The vapor seal skirt 164 may act as a trap for confining the wash liquid and/or vapor inside the interior 16 of the static wash tub 14. For example, the vapor seal skirt 164 may form a trap seal with the wash liquid in the catch basin 66. This trap seal may block the escape of wash liquid and/or vapor over the catch basin inner wall 160 from the catch basin 66 and the interior 16 of the static wash tub 14. Preventing the escape of wash liquid and/or vapor from the static wash tub 14 may prevent contact, and operational disruption, of the motor assembly 28 by wash liquid and/or vapor, and the migration of wash liquid and/or vapor into other parts of the laundry treating appliance 10 and/or to the exterior of the laundry treating appliance 10. In particular, the motor assembly 28 may be protected while wash liquid is pumped and drained through the recirculation system.

The wash liquid may percolate through laundry items in the wash basket 18, and drain downwardly by gravity through the drain holes 22, when the basket 18 is either in a stationary wash mode or a high-speed spin mode according to a selected cycle of operation. Upon exiting the drain holes 22, the wash liquid may flow downwardly along the conical surface of the closure 51 through one or more drain ports 54 to be received in the catch basin 66. During the wash phase, continuous recirculation of the wash liquid may maintain the wash liquid at a preselected height 162 in the catch basin 66 above the unattached end of the vapor seal skirt 164, which may be continuously monitored by a liquid depth sensor 166. The liquid depth sensor 166 may be electrically coupled with the controller 92, shown in FIG. 2, to signal when the depth of wash liquid in the catch basin 66 falls outside of a selected range of wash liquid depths. The selected range of wash liquid depths may reflect maintenance of the wash liquid in the catch basin 66 at a height above the unattached end of the vapor seal skirt 164.

During the high-speed spin extraction phase, the wash liquid may be drained from the laundry load in the basket 18 and the catch basin 66. The height of the wash liquid may consequently drop below the unattached end 170 of the vapor seal skirt 164, opening the catch basin 66 to the interior and exterior of the laundry treating appliance 10. Simultaneously, the wash basket 18, motor assembly 28, and bearing housing 38 may move upward under the influence of the suspension system 58 as the wash liquid is removed from the basket 18, also opening the catch basin 66 to the interior and exterior of the laundry treating appliance 10. Because the wash liquid may be removed from the catch basin 66, opening of the catch basin 66 to the interior and exterior of the laundry treating appliance 10 may have no effect on the contact, and operational disruption, of the motor assembly 28 by wash liquid and/or vapor, and the migration of wash liquid and/or vapor into other parts of the laundry treating appliance 10 and/or to the exterior of the laundry treating appliance 10. The vapor seal skirt 164 may then be isolated from the catch basin 66, thereby interrupting any vibration link between the wash basket 18, motor assembly 28, and bearing housing 38, and the catch basin 66 and cabinet 12. This may accommodate vibration of the basket 18 due to an unbalanced laundry load during a high-speed spin extraction phase with minimal effect on the static wash tub 14 and cabinet 12.

The previously described washing machines 10 and 110 with the static wash tub may be used to implement one or more embodiments of the invention. The embodiment of the invention may be used in increasing the size of the wash basket and correspondingly the treating capacity of laundry items by eliminating the clearance between the wash basket and the suspending tub. The embodiments of the invention may also be used to control the operation of the washing machines 10, 110 to improve the treating efficiency of the laundry items during the wash cycle by continuously or semi-continuously percolating the wash liquid through the laundry items in the wash basket. The embodiments of this invention may also be used in attaining the maximum rotational speed of the wash basket for high dehydration efficiency and/or eliminating the mechanical contact between the basket and tub during the dehydrating step. The embodiments of this invention may also be used in designing the washing machine 110 to which any balancing system is not provided by means of the rotatable tub that may rotate at substantially identical speeds with the wash basket. The embodiments of this invention may further be used in blocking the wash liquid and/or vapor escaping from the interior of the static wash tub such that mechanical parts such as the motor assembly may not be impinged by the wash liquid and/or vapor.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. The primary differences between the exemplary embodiments relate to the location of the static wash tub relative to the cabinet, presence of a rotatable tub, numbers and location of drain holes in the basket, the coupling of first and second bearing housing elements to the bearings, the location and number of suspension system assemblies, the location and configuration of the catch basin and pump, and these features may be combined in any suitable manner to modify the above embodiments and create new embodiments. As examples, the detergent dispenser may be provided with one or more conduits for providing one or more treating chemistries to the catch basin. The seal may not be limited to the labyrinth seal, and may include any mechanical seals providing seals preventing leakage. It is also noted that the rotatable tub may be provided to the washing machine with a bearing housing having the catch basin provided with the flange.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance comprising:

a cabinet;

a static wash tub coupled with the cabinet;

a wash basket mounted in the static wash tub and defining a laundry treating chamber, rotatable about a vertical axis and having a drain hole;

a rotatable wash tub provided between the wash basket and the static wash tub, rotatable about the vertical axis and having an opening;

a motor assembly for rotating the wash basket and the rotatable wash tub;

a catch basin annular about the vertical axis and defining an interior for holding a selected volume of wash liquid;

an annular bearing housing partially forming the catch basin, and at least partially provided around the motor assembly and spaced from the static wash tub;

a closure extending from the annular bearing housing and forming the catch basin with the annular bearing housing, and having a circumferential edge at least partially surrounding the static wash tub; and a suspension located exterior of the static wash tub and connecting the closure to the cabinet.

2. The laundry treating appliance of claim 1 wherein the motor assembly extends through the opening to couple to the wash basket.

3. The laundry treating appliance of claim 2 wherein the rotatable wash tub couples to the wash basket permitting simultaneous rotation of the rotatable wash tub and the wash basket.

4. The laundry treating appliance of claim 1 further comprising a first outlet portion coupled to the rotatable wash tub and defining the opening in the rotatable wash tub.

5. The laundry treating appliance of claim 4 further comprising a first bearing provided between the first outlet portion and the rotatable wash tub.

6. The laundry treating appliance of claim 4 further comprising a second outlet portion coupled to the annular bearing housing between the annular bearing housing and the motor assembly, and spaced from the first outlet portion to define an outlet.

7. The laundry treating appliance of claim 6 further comprising a second bearing provided between the second outlet portion and the motor assembly.

8. The laundry treating appliance of claim 6 wherein the outlet fluidly couples the laundry treating chamber to the catch basin.

9. The laundry treating appliance of claim 8 wherein the annular bearing housing is angled to direct a volume of liquid toward the closure and into the catch basin.

10. The laundry treating appliance of claim 1 wherein the static wash tub includes a first end portion coupled to the cabinet.

11. The laundry treating appliance of claim 10 wherein the static wash tub further includes a second end portion including a drain opening.

12. The laundry treating appliance of claim 11 wherein the drain opening drains into the catch basin.

13. The laundry treating appliance of claim 1 wherein the drain hole directs liquid to the rotatable wash tub.

14. The laundry treating appliance of claim 1 wherein the catch basin is below the wash basket, the rotatable wash tub, and the static wash tub.

15. The laundry treating appliance of claim 1 further comprising a sensing device for determining a height of wash liquid in the catch basin.

16. The laundry treating appliance of claim 1 wherein the rotatable wash tub and the wash basket are rotatable at substantially identical speeds.

17. The laundry treating appliance of claim 1 wherein rotation of the rotatable wash tub can centrifugally flow a volume of wash liquid along an inner wall of the rotatable wash tub to compensate for an unbalance of laundry items in the wash basket.

18. A laundry treating appliance comprising:

a cabinet defining an interior;

a static wash tub provided in the interior;

a wash basket mounted in the static wash tub and defining a laundry treating chamber, rotatable about a vertical axis and having a drain hole;

a rotatable wash tub provided between the static wash tub and the wash basket, rotatable about the vertical axis and having an opening;

a motor assembly for rotating the rotatable wash tub and the wash basket;

a catch basin disposed below and spaced from the static wash tub for holding a volume of wash liquid;

an annular bearing housing provided around at least a portion of the motor assembly and partially forming the catch basin, having a first end adjacent the motor assembly and a second end;

a closure extending from the second end of the annular bearing housing and forming the catch basin with the annular bearing housing, and having a circumferential edge at least partially provided around the static wash tub; and a suspension connecting the closure to the cabinet, wherein rotation of the rotatable wash tub can centrifugally flow at least some of a wash liquid along an inner wall of the rotatable wash tub to compensate for an unbalance of laundry items in the wash basket.

19. The laundry treating appliance of claim 18 wherein the rotatable wash tub is spaced from the annular bearing housing to define an outlet fluidly coupling the laundry treating chamber to the catch basin.

* * * * *